United States Patent [19]

Davis

[11] 4,231,173

[45] Nov. 4, 1980

[54] EXCAVATING TOOTH

[75] Inventor: Kerwin L. Davis, Meridian, Miss.

[73] Assignee: Esco Corporation, Portland, Oreg.

[21] Appl. No.: 966,517

[22] Filed: Dec. 4, 1978

Related U.S. Application Data

[63] Continuation-in-part of Ser. No. 769,857, Feb. 18, 1977, abandoned.

[51] Int. Cl.[3] ..... E02F 9/28

[52] U.S. Cl. ..... 37/142 R; 172/762

[58] Field of Search ..... 37/141 R, 141 T, 142 R, 37/142 A; 172/762; 403/318, 379

[56] References Cited

U.S. PATENT DOCUMENTS

| | | | |
|---|---|---|---|
| 1,808,311 | 6/1931 | Madonna | 37/142 R |
| 2,990,633 | 7/1961 | Van Buskirk | 37/142 R |
| 3,650,053 | 3/1972 | Baer | 37/142 A |
| 3,832,077 | 8/1974 | Von Mehren | 37/142 A X |
| 3,919,792 | 11/1975 | Hahn et al. | 37/142 R |
| 3,982,339 | 9/1976 | Nilsson | 37/142 R X |

FOREIGN PATENT DOCUMENTS

| | | | |
|---|---|---|---|
| 1918491 | 12/1970 | Fed. Rep. of Germany | 37/142 A |
| 2053156 | 5/1972 | Fed. Rep. of Germany | 37/142 A |
| 2238454 | 2/1974 | Fed. Rep. of Germany | 37/142 A |

*Primary Examiner*—E. H. Eickholt

*Attorney, Agent, or Firm*—Tilton, Fallon, Lungmus & Chestnut

[57] ABSTRACT

An excavating tooth especially adapted for use with large front end loaders which encounter repetitive jacking stresses, the point component of the tooth being equipped with uniquely sized bearing surfaces and rearwardly extending top and bottom tongues for the support of a vertical locking pin.

4 Claims, 9 Drawing Figures

EXCAVATING TOOTH

This application is a continuation-in-part of my copending application Ser. No. 769,857, filed Feb. 18, 1977 and now abandoned.

BACKGROUND AND SUMMARY OF INVENTION

Recent years have seen widespread introduction of large rubber tired front end loaders in mining operations previously handled by crawler-type shovel dipper or dragline machines. By "large" reference is made to loader buckets having a capacity of the order of 9–22 cubic yards (or 7–17 cubic meters). Key factors which influenced this trend were considerably lower capital investment, better supplier availability of machines to suit high demands, and more versatility and flexibility in application.

Typical mining applications of front end loaders are stripping overburden and loading of ore or coal. Overburden tends to be a mixture of fines and medium-to-large blocks or slabs of shot material such as sandstone, limestone, basalt, quartz rock mixed with shales and clay. Ores typically are mixtures of fines and small-to-medium sized chunks which are denser than overburden. Coal, which is lighter than overburden in weight, is usually shot and is deposited in veins or seams that many times are multi-seam type separated by overburden partings. The front end loader buckets generally require teeth to dig and load these materials.

In order for a front end loader vehicle to get a load of material in its front-mounted bucket, it must first advance nearly horizontally into the material and then sweep up in an arc under the trapped material. To accomplish this, the bucket and loader encounter the aforementioned material which is difficult to load due to the very extreme variations in size and shape plus weight variations. The chunks or slabs tend to interlock and require high energy to penetrate and prize or lever the material into the bucket. Uneven terrain, which is generally typical, further reduces ease of penetration into the material.

To overcome these many and varied loading obstacles, a front end loader which is propelled through an articulated chassis on rubber tires, moves the bucket hydraulically in an up and down, arc-type or combination direction, producing two types of medium-to-high load forces on the tooth system. First, there is the penetration load form developed as the front end loader and bucket advances into the material being loaded. The variables of material size, weight and location require the teeth to gouge, break out and dig under the material in a fashion analogous to that encountered in a dozer. Second, a jacking or fluttering loading is encountered due to the variables in material shape and location as the teeth are moved up and down to allow both forward and upward bucket penetration through tight openings between chunks, blocks or slabs. More particularly, the jacking or fluttering of the tooth system stems from the sporadic engagement of the teeth with difficult to dislodge material whereby the teeth move up or down or even laterally in order to pass beyond the obstinate material. It will be appreciated that this is not usually uniform across the width of the bucket so that different teeth may be in different fluttering and penetration modes at the same time. Although, the background of the invention is discussed in terms of front end loaders and, more particularly, the jacking operation which characterizes them, such jacking operations have been characteristic of earlier earth moving devices, though generally not as severe. In other words, the problem has existed but had not been brought home to art workers quite as strongly prior to the advent of the large front end loader.

The severity of these jacking forces particularly in front end loaders gave rise to difficulties with conventional excavating teeth, particularly those which consisted of components secured to a vertically extending lock or key.

The vertically extending lock has, and still is, the preferred form for connecting the point and adapter components of the tooth. Inasmuch as the point components, in particular, wear rapidly, replacement is frequent—in some instances, daily. With a vertically extending lock, disengagement of the point from the adapter is easily achieved by merely using a hammer or sledge to pound out the locking pin. In contrast, the horizontally installed locking devices are difficult to remove because there is generally only a short distance between adjacent teeth, thereby limiting the type of drift pin or chisel and hammer or sledge arc—so much so that horizontally locked teeth have become known in the field as "knuckle-busters". Thus, horizontally extending pins were undesirable because of the difficulty of removal. On the other hand, the vertically extending pins were subject to ejection in the jacking mode. The loss of the locking pin (as from severe jacking) constitutes one of the most devastating things that can happen to an excavating tooth. Without the pin, the point generally will come off, exposing the adapter—and, if the machine is not stopped immediately, the adapter can be ruined because it is not intended to be the penetrating component. Even the stoppage is expensive—particularly when unscheduled.

Among the teeth that suffered from this loss of pin drawback were those constructed according to U.S. Pat. Nos. 2,919,506 and 3,079,710. These teeth made use of a combination of special bearing surfaces to absorb severe shock loads and to prevent the development of localized strains and negative thrust, these teeth having been referred to as "stabilized conicals".

Negative thrust tends to pull the point off the adapter. Prior to the 3,079,710 patent, this was resisted by providing a pin lock structure which was characterized by high shear and bearing strength to provide an artificial positive thrust at installation. Such an artificial positive thrust meant extreme difficulty in pin lock removal—thereby frustrating one of the principal objectives of a pin lock: easy removability for replacement while still providing secure locking during working.

The stabilized conical tooth changed the tooth standards—previously the trend was to tighter and tighter fits between the point and adapter to avoid localized strain and negative thrust, and to use bigger and stronger pin locks to resist negative thrust. With the supplemental beam and conical bearing surfaces of the stabilized conical tooth, a most desirable looseness in fit not only could be tolerated—but put to advantage, all while using a light, easily installed and removed pin lock system. Stabilized conical teeth, which had performed brilliantly under all conditions throughout the world for many years started coming apart due to locking pin loss when used on front end loaders. Thus, with the more frequent incidence or severity of the "jacking" stresses, this whole advantageous trend was jeopardized. For example, more frequent loss of pins made the desirable loose fit suspect. Here it should be appreciated that excavating teeth are designed for the exceptional occurrence—the relatively infrequent stress or impact that might destroy the system. If the excavating were always performed in dry sand—the only problem is abrasion. But the manufacturers of excavating equipment, particularly teeth, cannot be sure that a particular piece of equipment may not be moved from a stressless environment to one having high impact loadings. So teeth must be built to withstand the infrequent but severe stresses—the connection of the tooth parts must approach the strength of the connection of the bucket itself.

The stabilized conical tooth point was felt to be the best design because it was rugged, simple, had a relatively massive box section for strength and resistance to corner stresses, had conical bearing surfaces to resist lateral loads, and stabilizing "flats" to resist negative thrust. Yet, with all of this, it was this highly regarded tooth that encountered difficulty in staying together on front end loaders subject to jacking stresses.

The instant invention solved this problem of severe jacking stresses. According to the invention, the vertical pin lock is still used—no need for going to the "knuckle-buster". Further, the real advantage of looseness of fit is still present—contrary to expectation, and along with still being able to use the simple, lightweight pin lock system.

At first this was not felt possible because problems were experienced with the logical approach of making the pin installation more secure. The vertical lock in the stabilized conical tooth was of the corrugated type seen in U.S. Pat. No. 3,126,654. When these teeth encountered pin loss problems, the initial attempts focused on the pin locks themselves—changing the corrugated contour as seen, for example, in U.S. Pat. No. 4,061,432. This improved the situation relative to jacking but was not a complete answer so that in especially difficult cases, return to the horizontal pin lock was considered. The obvious solution to the problem (while still retaining the vertical pin lock) was to deform the pin as in U.S. Pat. No. 2,055,265—but this then created a problem of removal.

As a last ditch effort to avoid going to this unattractive arrangement, tests were performed with a tooth construction not used in excavating but only in dredging. Surprisingly enough, this different arrangement showed promise in solving the pin loss problem due to jacking of front end loader teeth. This was surprising because the dredge teeth were designed for a different function. For example, the forces normally encountered in dredging were generally random and seldom applied at angles greater than 45° to the longitudinal center line. In contrast, the jacking stresses were cyclic and often applied at angles of 80° to the longitudinal centerline.

Further, contra-indicating the use of the dredge tooth structure was the design of the point itself. It had, at the rear of the point, four rearwardly extending tongues—one for each of the top, bottom and sidewalls. The idea of having four rearwardly extending tongues on a point was old as shown by U.S. Pat. No. 1,803,311 and more recently, in U.S. Pat. No. 3,708,895, this being representative of the use of rearwardly extending tongues in the dredge point art. Also representative of the dredge point art is the structure seen in commonly-owned U.S. Pat. No. 4,080,708 where, in addition to the rearwardly extending tongues, the tooth is equipped with internal stabilizing bearing surfaces at the apex of the point socket according to U.S. Pat. No. 3,079,710. It was this 4,080,708 patent structure that showed the promise indicated above. This was unexpected because pin securement was deemed to stem from having a strong structure around the pin—as for example, a continuous section, viz., a box, at the point rear as in U.S. Pat. No. 3,790,353—rather than one that was essentially "weakened" by the removal of metal, in effect, from the box section to provide the tongues.

It is believed that the rearwardly extending tongues, particularly those extending from the top and bottom walls through which the vertical pin extends cooperate in a new manner with the stabilizing flats. These top and bottom tongues, by virtue of the fact that they support the pin independently of the remainder of the box section now can accommodate to the pin shift upon the application of the cyclic forces incident to jacking.

Not only was it necessary to go to a completely contra-indicated point rear end structure (the four tongues) but it was also essential to provide a specific forward part, viz., the dimensional arrangement of the so-called "stabilizing flats". The advantages of a vertically installed pin or keylock can be retained in an excavating tooth which is subject to the severe jacking stresses on a front end loader where the supplemental bearing surfaces are constructed to have a width to length ratio of approximately 2.5 and with the surfaces separated so that the section between surfaces has a width to spacing ratio of approximately 1.8. More particularly, the adapter nose and conforming point socket are defined by forwardly convergent top and bottom walls which terminate in a generally box shaped apex which in turn provides generally parallel stabilizing upper and lower surfaces—each of these surfaces having a width to length ratio of approximately 2.5 and the surfaces separated to obtain a width to thickness ratio of approximately 1.8 thus providing an optimum configuration balancing the considerations of surface area, strength vs. weight and external shape of point.

DETAILED DESCRIPTION

The invention is described in conjunction with an illustrative embodiment in the accompanying drawing, in which FIG. 1 is a perspective view of a front end loader employing teeth constructed according to the teachings of the instant invention;

Figure 1:
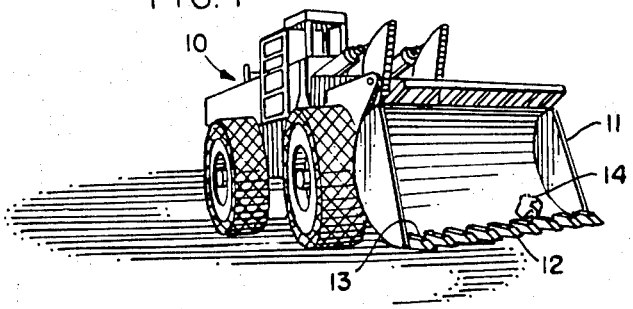

In the illustration given, and with reference first to FIG. 1, the numeral 10 designates generally a wheel equipped tractor or like vehicle which supports at its forward end a bucket 11 equipped with a plurality of excavating teeth 12 along the bottom forward edge 13. The bucket 11 is shown in its penetration or material entering mode and a small amount of material 14 is seen within the bucket 11. As further material is accumulated, the bucket 11 is swung upwardly preparatory to swinging laterally and dumping the load.

Figure 2:
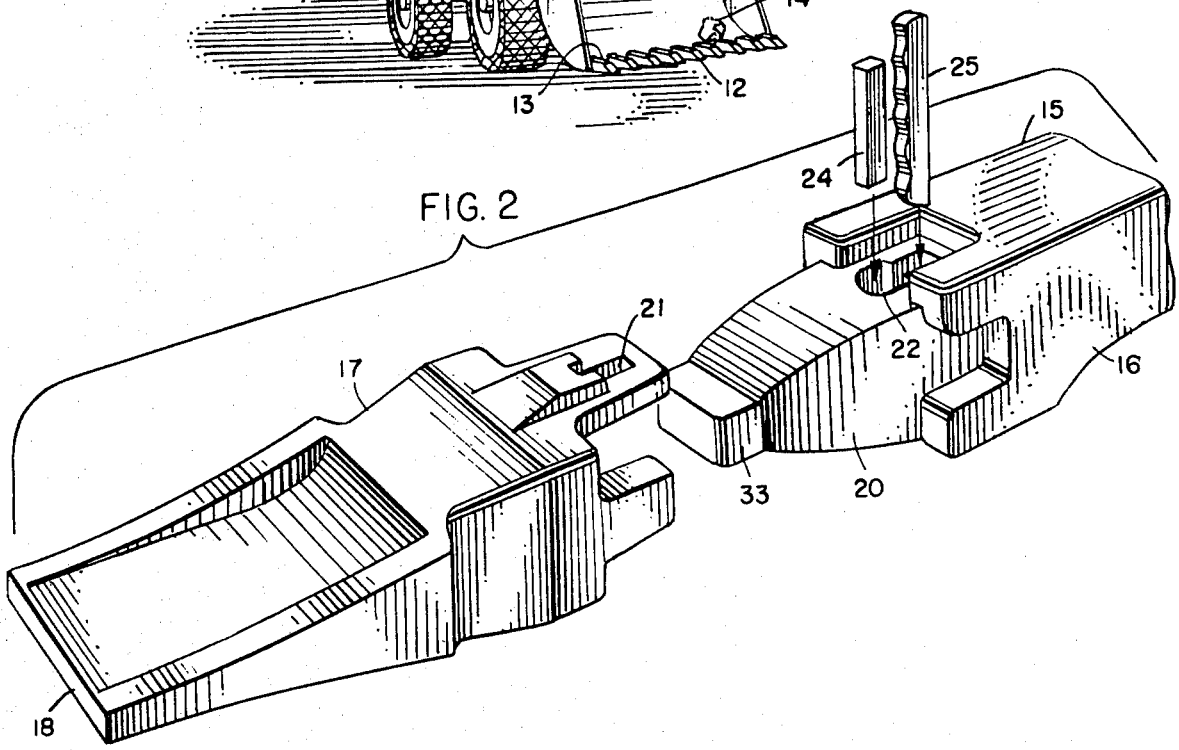
FIG. 2 is a an exploded perspective view of the inventive excavating tooth with the parts separated and with the adapter component illustrated in fragmentary form.

The teeth that have been found especially advantageous for the severe operating conditions previously discussed include a supporting member 15 (normally called an "adapter") which is fixed to the bottom wall of the bucket 11 as by welding along the undersurface 16. Inasmuch as the adapter 15 is not the principal penetrating component, the life expectancy is such as to accommodate a series of replacement points, one of which is designated 17 in FIG. 2. The point 17 is equipped with a leading or penetrating edge 18 at one end and at the other end with a socket 19 shown in dotted line in FIG. 4. The socket 19 conforms to and receives the forward portion or nose 20 of the adapter 15.

For the purpose of releasably securing the point 17 on the adapter 15, aligned openings as at 21, 22 and 23 are provided. As can be appreciated from a comparison of the showings in FIGS. 2, 4 and 6, the openings 21 and 23 are provided in the point 17 while the opening 22 is provided in the adapter 15. The opening 22 in the adapter 15 is enlarged to receive and support a resilient plug member 24 (see the upper right hand portion of FIG. 2) which serves as a lock for a vertically elongated pin 25 which extends through the aligned openings 21–23.

Figure 3:
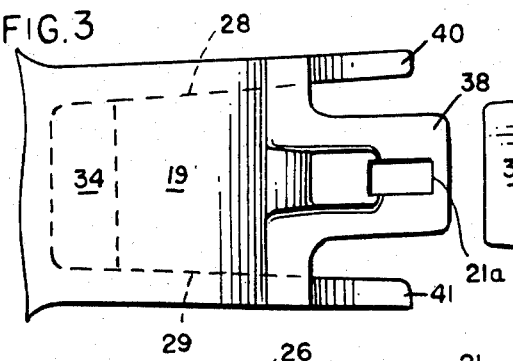
FIG. 3 is a top plan view of the point component of the tooth of FIG. 2.
Figure 5:
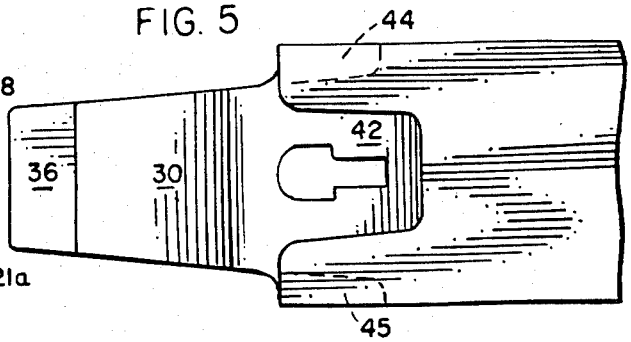
FIG. 5 is a top plan view of the adapter component of the FIG. 2 tooth.

The socket 19 (referring to FIG. 4) is defined by top and bottom walls 26 and 27 and by sidewalls 28 and 29 (see FIG. 3). The sidewalls 28 and 29 are slightly convergent in a forward direction to provide the necessary draft for casting. The forward convergence of the top and bottom walls 26 and 27 is more pronounced and optimally the walls 26 and 27 (and the corresponding confronting walls 30 and 31—see FIGS. 5 and 6) are longitudinally arcuate along a parabolic curve.

Figure 4:
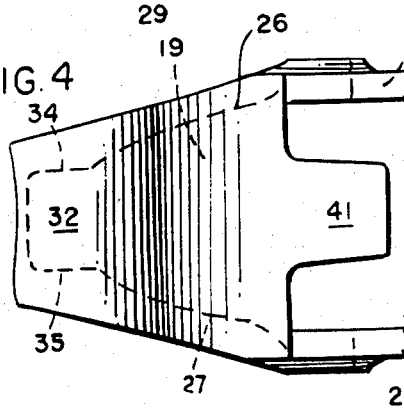
FIG. 4 is a side elevational view of the point of FIGS. 2 and 3.
Figure 6:
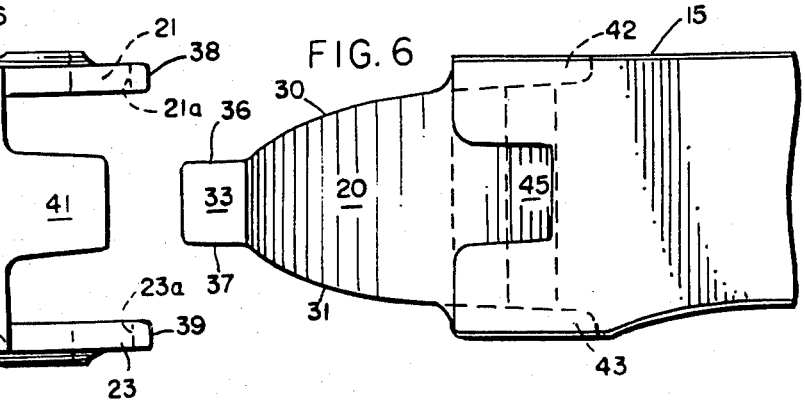
FIG. 6 is a side elevational view of the adapter of FIGS. 2 and 5.

The socket 19 and the conforming nose 20 each terminate in an apex which is box-shaped as at 32 relative to the socket 19 and 33 relative to the nose 20 (compare FIGS. 4 and 6). Relative to the box shaped apex 32 in the socket 19, generally parallel upper and lower surfaces 34 and 35 are provided as extension of the top and bottom walls 26 and 27. I have discovered that the advantageous operation previously described is achieved when the surfaces 34 and 35 (and the corresponding surfaces 36 and 37) in the apex portion 33 of the nose 20 are constructed with a width to length ratio of about 2.5. By length, I refer to the longitudinal dimension of the tooth, i.e., the dimension extending between the penetrating end 18 and the open end of the socket 19. For example, the prior art teeth were made with "flats" having a width of 115 mm., a length of 13 mm. and a spacing of 30 mm. yielding a W/L ratio of 8.85 and a W/S ratio of 3.83 for the size tooth having a nominal dimension of 5½" (140 mm.) across the base of the nose. The inventive tooth has a corresponding W/L or surface ratio of 2.55 and a W/S or spacing ratio of 1.83 derived from a width of 71.5 mm., a length of 28 mm. and a thickness of 39 mm. For a larger size of inventive tooth corresponding to the prior art tooth having a nominal width of 8½" (215 mm.) across the base of the nose, I provide a width of 114 mm., a length of 44 mm. and a spacing of 63.5 mm., yielding a W/L ratio of 2.59 and a W/S ratio of 1.80.

Additionally, I have found it advantageous to provide the keyway opening as illustrated in the accompanying drawing. For example, each of the walls 26–29 is extended rearwardly to provide ears 38–41 (compare FIGS. 3 and 4). The ears 38–41 are received within correspondingly contoured recesses 42–45 within the adapter 15. The ears 38 and 39 project rearwardly further than the ears 40 and 41 and it is seen that the rear walls 21*a* and 23*a* of the aligned openings 21 and 23 are spaced rearwardly of the rear edges of the tongues 40 and 41. Thus, the location of the keyway is spaced rearwardly of the nose 20 so as to retain the integrity of the nose and socket and thus develop more effective resistance to severe bending loads, particularly those incident to jacking or fluttering.

In operation, during the aforementioned jacking or fluttering loading, the stabilizing surfaces 34 and 36 or 35 and 37 come into engagement. These surfaces are spaced apart slightly in order to achieve a fit and are sized accordingly to the optimum relationship previously described so as to withstand the maximum encountered bending loads incident to jacking. The rearwardly extending ears 38–41 may also assist in a secondary manner in resisting such bending loads. Although it is preferred to utilize all four ears 38–41, in some instances it may be satisfactory to utilize only the upper and lower ears 38 and 39, reinforced if necessary.

Figure 7:
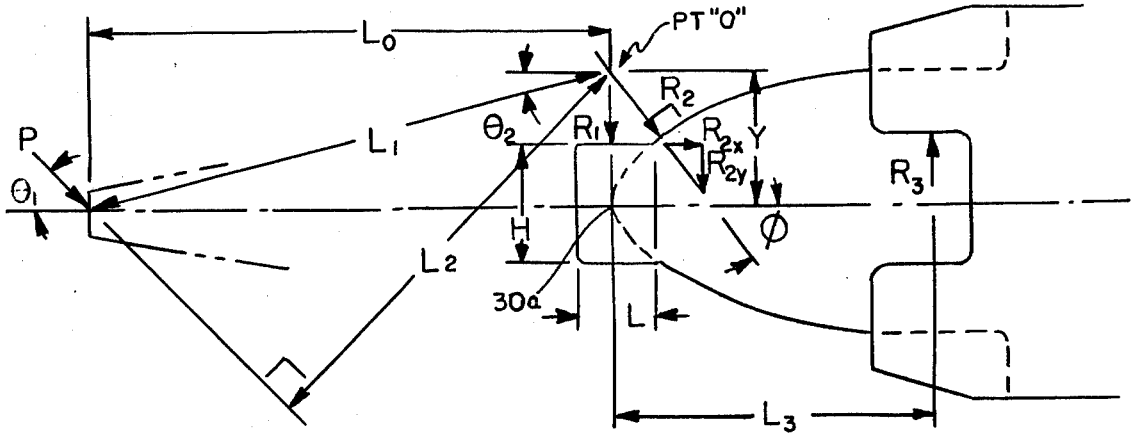
FIG. 7 is a diagrammatic view (a side elevation) of a tooth showing various forces, lever arms and angles identified thereon.
Figure 8:
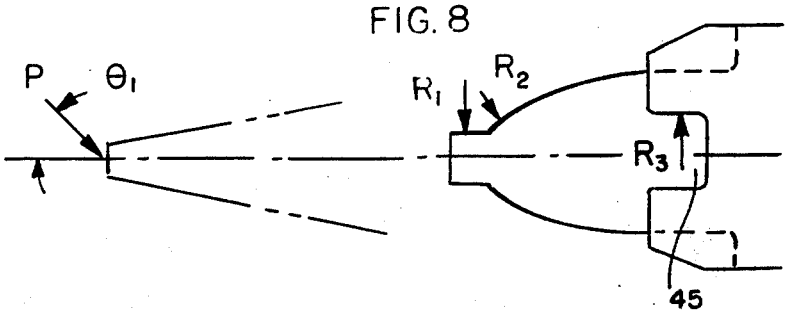
FIG. 8 is a simplified version of FIG. 7.
Figure 9:
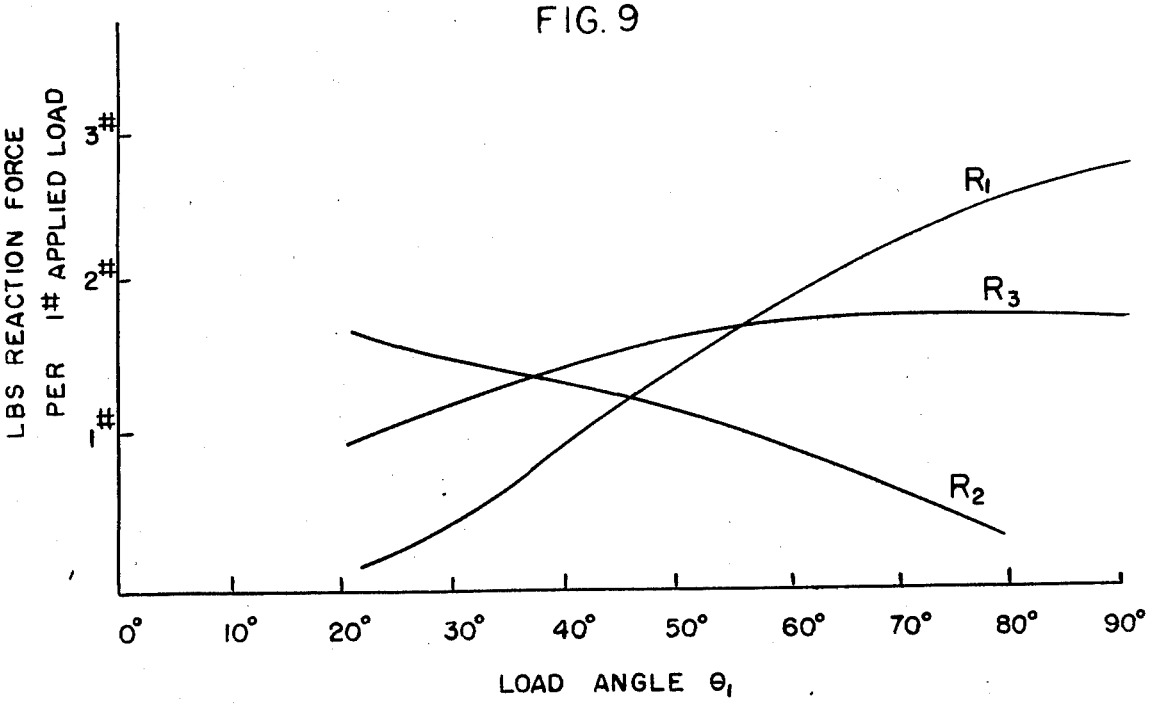
FIG. 9 is a plot of the reaction force ratio as a function of the load angle.

The fact that the jacking operation results in different forces acting on the adapter nose 20 from those encountered during dredging can be demonstrated mathematically—with reference to the diagrams on the second drawing sheet, viz., FIGS. 7–9. As can be first appreciated by a consideration of FIG. 8, the load P applied to the point 17 at an angle $\theta_1$ (to the longitudinal center line of the point) results in forces $R_1$, $R_2$ and $R_3$ acting on the nose 20.

More particularly, $R_1$ is the reaction force on the "flats", viz., the surfaces 36 or 37; $R_2$ is the cone reaction force, viz., the forwardly convergent walls 30 and 31 while $R_3$ represents the reaction force on the walls of the ear sockets 44 and 45. The load P is defined as being applied at a distance $L_0$ from the imaginary intersection of the surfaces 30 and 31—see the dashed line 30*a* in FIG. 7. To compute the reaction forces, certain trigonometric relationships are established from the dimensions represented in FIG. 7. For example:

$$\theta_2 = \tan^{-1}(Y/L_0)$$

$$L_1 = L_0/\cos\theta_2$$

$$L_2 = L_1\,[\sin(\theta_1+\theta_2)]$$

$R_2$ can be derived from summing the x or horizontal forces to zero, i.e., $\Sigma F_x = 0$. The x component of $R_2$, viz., $R_{2x}$ can be seen to be P cos $\theta_1$. The y component ($R_{2y}$) is $R_{2x}\tan\phi$. From this hypotenuse $R_2$ is seen to be $$R_2 = P\cos\theta_1\,(1+\tan^2\phi)^{\frac{1}{2}}$$

$R_3$ can be derived from summing the moments to zero, viz. $\Sigma M_0 = 0$, from which $$R_3 = P\,(L_2)/(L_3), \text{ or}$$

$$R_3 = P\frac{L_o[\sin(\theta_1+\theta_2)]}{L_3(\cos\theta_2)}$$

$R_1$ can be derived from summing the y or vertical forces to zero, i.e., $\Sigma F_y=0$. From this:

$$R_1=P\sin\theta_1-R_{2y}+R_3, \text{ or}$$

$$R_1=P\sin\theta_1-P\cos\theta_1\tan\phi+R_3, \text{ or}$$

$$R_1=P[\sin\theta_1-\cos\theta_1\tan\phi]+R_3$$

When $\phi$ is determined to be 55° for a constant strength parabolic cantilever, defined by Y=constant times square root of X and passing through coordinates determined by W/L=2.5 and W/H=1.8 as in FIG. 7, a series of values of $R_1$, $R_2$ and $R_3$ can be obtained as a function of P and $\theta_1$. The ratio of these reaction forces to the applied load P, viz., $R_1/P$, etc., is plotted as a function of $\theta_1$ in FIG. 9. From this, the following is seen:

1. At low $\theta_1$, the thrust is on the cone, no appreciable load on the "flats";
2. At medium $\theta_1$ ($\theta_1 \leqq 45°$), the load on the flats is not as great as the load on the cone; and
3. At high $\theta_1$ ($45° < \theta_1 < 90°$) the force on the flats is quite high.

This was not characteristic of the dredge tooth operation, previously referred to and wherein there happened to be rearwardly extending top, bottom and side tongues and flats. In the dredge teeth, there was no simple plane in which the forces would usually be applied, so the design reflected virtually the same elements top and bottom as on the sides, viz., flats and rearwardly extending tongues. Thus, a force applied in a horizontal plane would be resisted in approximately the same manner as one applied in the vertical plane. This operation was not characteristic of the excavating teeth subject to jacking so there was no indication that a combination of flats and ears, much less the optimum arrangement presented herein, would be effective in resisting jacking forces. Thus, not only was there a difference in the type of stress encountered between excavating and dredging teeth, but there was also difference in basic philosophy. That design philosophy, as just indicated, resulted in virtually a square apex in the nose and socket to accommodate omni-planar forces. Thus, there was nothing either from the design or the operation standpoints to indicate that any dredge tooth concepts would be helpful in an excavating tooth subject to jacking stresses.

The criticality of the arrangement proposed, viz., the rearwardly extending ears and the dimensional ratios concerning the flats can be appreciated from the fact that the strength of the flats matches the strength of the nose at the keyway opening 22 for high $\theta$ loadings.

The strength of the flats can be analyzed by published stress formula developed in the '40's and '50's by N.A.C.A. (NASA's predecessor) and S.A.E., for short, broad cantilevers such as parallel gear teeth, which the flats resemble in form and function. The force on the flats is taken as acting at the apex 30*a* of a parabolic (in the side view) constant-strength section, which is the basic shape of the nose illustrated. This results in a stress level of ($R_1$/W) (5.8).

Utilizing the formula for a cantilever nose where 33% of the nose width is taken up by the keyway opening, the stress level at the keyway is also ($R_1$/W) (5.8).

When flats are sized larger than the optimum recited (smaller W/H and W/L numbers), this results in a prediction of flats of excess strength relative to the critical section across the keyway. In addition, the required volume of metal increases, but at a greater rate, so the strength-to-weight ratio decreases and metal use is inefficient relative to the optimum. When flats are sized smaller than the optimum (larger W/H and W/L numbers), the top and bottom surfaces areas available to carry the contact forces acting on them are reduced—if this reduction of area is significant, detrimental peening and surface deformation results.

While in the foregoing specification a detailed description of an embodiment of the invention has been set down for the purpose of illustration, many variations in the details hereingiven may be made by those skilled in the art without departing from the spirit and scope of the invention.

I claim:

1. In an excavating device having a front end loader bucket, a plurality of teeth secured to said bucket and projecting forwardly therefrom, each of said teeth including an adapter fixed to said bucket and equipped with a forwardly projecting nose, a point releasably mounted on said nose, said point including a relatively elongated metal body having a transverse penetrating edge at the forward end and an adapter nose-receiving socket at the rear end, said socket being defined by top, bottom and sidewalls in said body corresponding to confronting walls on said nose with said socket top and bottom walls being forwardly convergent and said socket walls terminating forwardly in a generally box-shaped apex providing generally parallel upper and lower apex surfaces, each upper and lower surface having a length dimension and a transverse dimension with the transverse dimension being parallel to said penetrating edge, said transverse dimension being approximately 2.5 times said length dimension, said upper and lower apex surfaces being vertically spaced apart to provide a transverse dimension to the spaced apart dimension in the ratio of approximately 1.8, each of said socket walls in the point being rearwardly extended to form integral ears, said adapter being equipped with recesses to receive said ears, the ears associated with said top and bottom walls being equipped with aligned openings for the receipt of a lock means, said adapter being equipped with a vertically extending opening aligned with said ear openings, and a lock means removably mounted in the said aligned openings.

2. An excavating tooth point especially suited to resist repetitive jacking stresses attendant to earth moving comprising a relatively elongated metal body having a transverse penetrating edge at the forward end and an adapter nose-receiving socket at the rear end, said socket being defined by top, bottom and sidewalls in said body with said socket top and bottom walls being forwardly convergent and said socket walls terminating forwardly in a generally box shaped apex providing generally parallel stabilizing upper and lower apex surfaces, each upper and lower surface having a length dimension and a transverse dimension with the transverse dimension being parallel to said penetrating edge, and said transverse dimension being approximately 2.5 times said length dimension, said upper and lower apex surfaces being vertically spaced apart to provide a transverse dimension to the spaced apart dimension in the ratio of approximately 1.8, each of said socket top and bottom walls being rearwardly extended to form an integral ear, said ears being equipped with aligned openings for the receipt of a locking pin.

3. The structure of claim 2 in which said sidewalls are also equipped with rearwardly extending ears, the wall ears associated with said top and bottom walls projecting further rearwardly than said side wall ears, said pin-receiving openings having a rear wall surface located rearwardly of said side wall ears.

4. The structure of claim 3 in which said sidewalls are slightly convergent in a forward direction to provide draft.

* * * * *